US007337937B2

(12) United States Patent
Klamt et al.

(10) Patent No.: US 7,337,937 B2
(45) Date of Patent: Mar. 4, 2008

(54) STITCHING APPARATUS

(75) Inventors: Holger Klamt, Leipzig (DE); Siegmar Tischer, Borsdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/523,342

(22) Filed: Sep. 19, 2006

(65) Prior Publication Data

US 2007/0075110 A1 Apr. 5, 2007

(30) Foreign Application Priority Data

Sep. 19, 2005 (DE) ..... 10 2005 044 707

(51) Int. Cl.
*B25C 5/08* (2006.01)

(52) U.S. Cl. ..... 227/89; 227/82; 227/87; 227/88; 227/92

(58) Field of Classification Search ..... 227/82, 227/87–89, 92
See application file for complete search history.

(56) References Cited

U.S. PATENT DOCUMENTS

| | | | | |
|---|---|---|---|---|
| 3,876,129 | A * | 4/1975 | Bulka | 227/88 |
| 4,335,841 | A * | 6/1982 | Fogarasy | 227/90 |
| 4,410,123 | A * | 10/1983 | Kunka et al. | 227/8 |
| 4,444,347 | A * | 4/1984 | Males | 227/88 |
| 4,850,520 | A | 7/1989 | Schumann et al. | |
| 5,098,002 | A | 3/1992 | Hänsch et al. | |
| 5,361,962 | A | 11/1994 | Andersen et al. | |
| 5,921,455 | A * | 7/1999 | Dickhoff | 227/86 |
| 7,032,898 | B2 * | 4/2006 | Silberbauer | 270/52.18 |
| 7,159,746 | B2 * | 1/2007 | Duff | 227/86 |

FOREIGN PATENT DOCUMENTS

| | | |
|---|---|---|
| CH | 549 443 | 5/1974 |
| DE | 38 10 142 A1 | 11/1988 |
| DE | 296 21 225 U1 | 3/1997 |
| EP | 0 399 322 A2 | 11/1990 |

* cited by examiner

*Primary Examiner*—Rinaldi I. Rada
*Assistant Examiner*—Gloria R. Weeks
(74) *Attorney, Agent, or Firm*—Laurence A. Greenberg; Werner H. Stemer; Ralph E. Locher

(57) ABSTRACT

A stitching apparatus for manufacturing stitching wire staples, in particular annular eyelet staples, for stitching stacked sheet materials, includes a stitching head basic body having a driver for driving the stitching wire staples into the stacked sheet materials in a downward movement of the driver. A former shapes the stitching wire staples, in particular annular eyelet staples. The former is pivoted away during the downward movement of the driver. A wire clamping lever is mounted pivotably in the former. The wire clamping lever has a control element which runs on a control cam in such a way that the former is supported as a result in the upward movement of the driver, with the result that the former is pivoted-in in the upward movement to a different point than the pivoting-out of the former in the downward movement.

4 Claims, 4 Drawing Sheets

STITCHING APPARATUS

CROSS-REFERENCE TO RELATED APPLICATION

This application claims the priority, under 35 U.S.C. § 119, of German Patent Application DE 10 2005 044 707.4, filed Sep. 19, 2005; the prior application is herewith incorporated by reference in its entirety.

BACKGROUND OF THE INVENTION

Field of the Invention

The present invention relates to a stitching, stapling or binding apparatus for manufacturing stitching wire staples, in particular annular eyelet staples, for stitching stacked sheet materials. The stitching apparatus includes a stitching head basic body with a driver for driving the stitching wire staples into the stacked sheet materials in a downward movement of the driver. A former shapes the stitching wire staples, in particular annular eyelet staples. The former is pivoted away during the downward movement of the driver. A wire clamping lever is mounted pivotably in the former.

Such stitching, stapling or binding apparatuses are used, in particular, in gathering and stitching machines for producing gathered and stitched brochures, for instance magazines. Accordingly, stitching apparatuses of that type are known, for example, from German Patent DE 44 44 220, corresponding to U.S. Pat. No. 5,516,024, or from German Published, Non-Prosecuted Patent Application DE 197 12 876, corresponding to U.S. Pat. No. 6,119,911. In particular, stitching apparatuses of the generic type, as shown in FIG. 1, are marketed by the firm Hohner Maschinenbau GmbH.

Referring now to FIG. 1 in detail, there is seen a stitching apparatus 100 for producing stitching wire staples, in particular annular eyelet staples, for stitching stacked sheet materials. The stitching apparatus includes a stitching head basic body 5 having a driver 80 for driving stitching wire staples into stacked sheet materials in a downward movement of the driver 80. The stitching apparatus also includes a former 60 for shaping the stitching wire staples, in particular annular eyelet staples. The former 60 is pivoted away during the downward movement of the driver 80. The stitching apparatus has a wire clamping lever 63 being mounted pivotably in the former 60. Moreover, the former 60 has a supporting lever 61, on the end of which a roller 62 is mounted rotatably. The roller rolls along specific cam faces on the driver 80 during the upward movement of the driver 80, so that the former 60 is supported as a result in the upward movement of the driver 80. As a result, the former 60 is pivoted-in in the upward movement to a different point than the pivoting-out of the former 60 in the downward movement. The supporting lever 61 and the roller 62 are pretensioned on the former 60 with a non-illustrated spring. The former 60 may not yet pivot-in during the upward movement of the driver, in order to ensure that stitching wire 1 can be advanced again and cut for the formation of the next staple.

A disadvantage of that construction is that it is complicated, susceptible to disruptions and noise-intensive. However, it would be desirable to make a stitching apparatus available which operates simply, with a low number of disruptions and comparatively quietly.

SUMMARY OF THE INVENTION

It is accordingly an object of the invention to provide a stitching apparatus for manufacturing stitching wire staples, in particular annular eyelet staples, for stitching stacked sheet materials, which overcomes the hereinafore-mentioned disadvantages of the heretofore-known devices of this general type and which operates simply, with a low number of disruptions and comparatively quietly.

With the foregoing and other objects in view there is provided, in accordance with the invention, a stitching apparatus for manufacturing stitching wire staples, in particular annular eyelet staples, for stitching stacked sheet materials. The apparatus comprises a stitching head basic body having a driver for driving the stitching wire staples into the stacked sheet materials in a downward movement of the driver. A former shapes the stitching wire staples, in particular annular eyelet staples. The former is pivoted away during the downward movement of the driver. A wire clamping lever is mounted pivotably in the former. The wire clamping lever has a control element running on a control cam to support the former in an upward movement of the driver, for pivoting-in the former in the upward movement to a different point than a pivoting-out of the former in the downward movement.

Accordingly, the stitching apparatus of the invention has a control element on the wire clamping lever. The control element realizes the desired movement sequence in interaction with a control surface. As a result, an additional supporting lever which is moved by spring force, is mounted rotatably and is provided with a roller, is omitted, as a result of which the desired advantages can be achieved. Since the overall construction has considerably fewer moving parts and the wire clamping lever assumes an additional task by way of the control bolt, the stitching apparatus according to the invention is simpler and also has a lower number of disruptions. In addition, the specific cam surfaces which were necessary previously are combined in a control block. Overall, the construction also becomes more inexpensive in assembly as a result. The development of noise can also be reduced by the reduced number of parts. Furthermore, the stitching apparatus according to the invention is also more space-saving, since the additional parts in the space between the former and the driver are omitted.

In accordance with a concomitant feature of the invention, the control element is a control bolt which is advantageously guided along a control cam that includes a plurality of control cam sections and is configured in a control block. The control block is disposed on a slide in the stitching head basic body. The former is advantageously pretensioned against the control block by a non-illustrated compression spring.

Other features which are considered as characteristic for the invention are set forth in the appended claims.

Although the invention is illustrated and described herein as embodied in a stitching apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
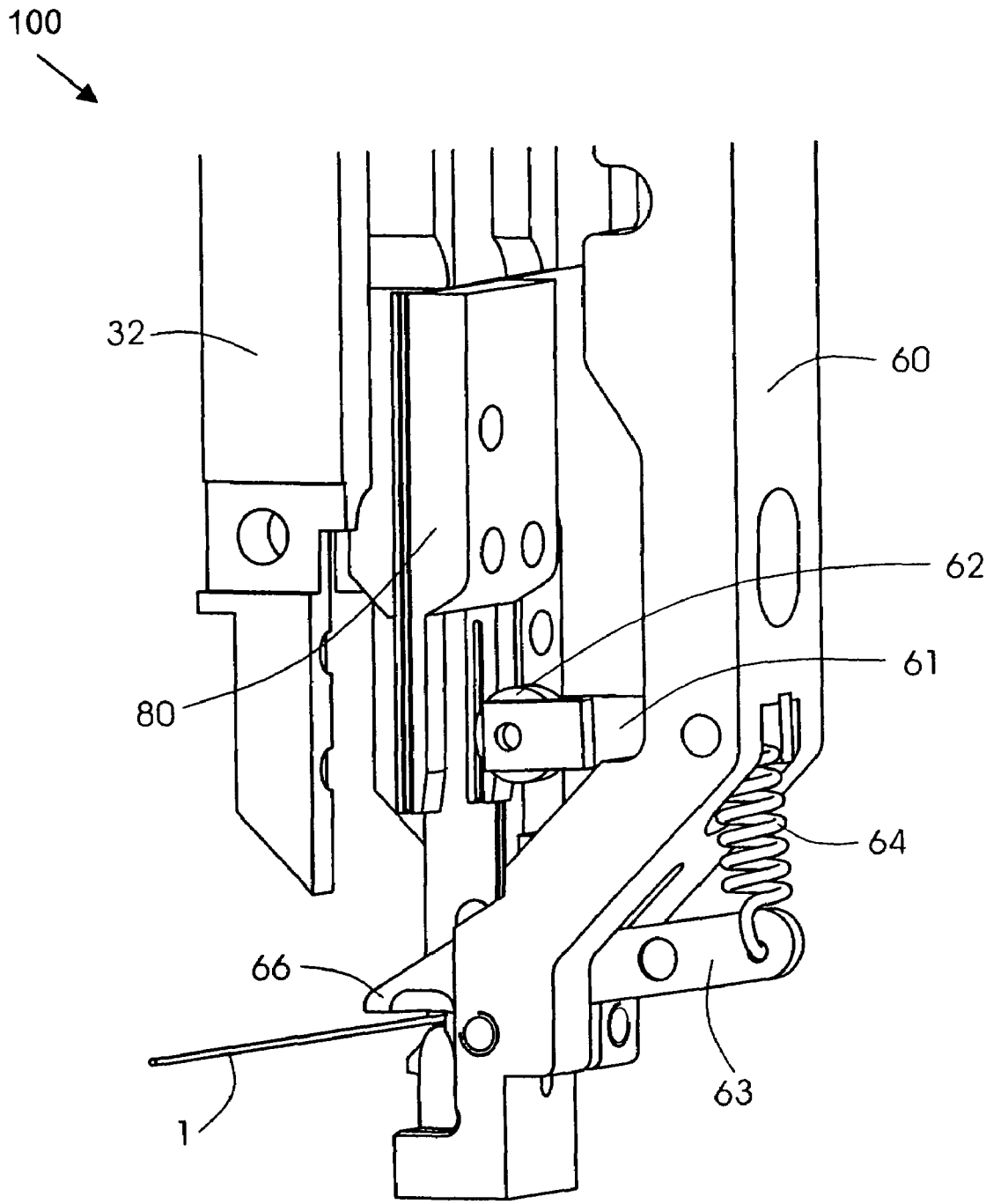
FIG. 1 PRIOR ART
FIG. 1 is a fragmentary, diagrammatic, perspective view of a generic stitching apparatus according to the prior art.
Figure 2:
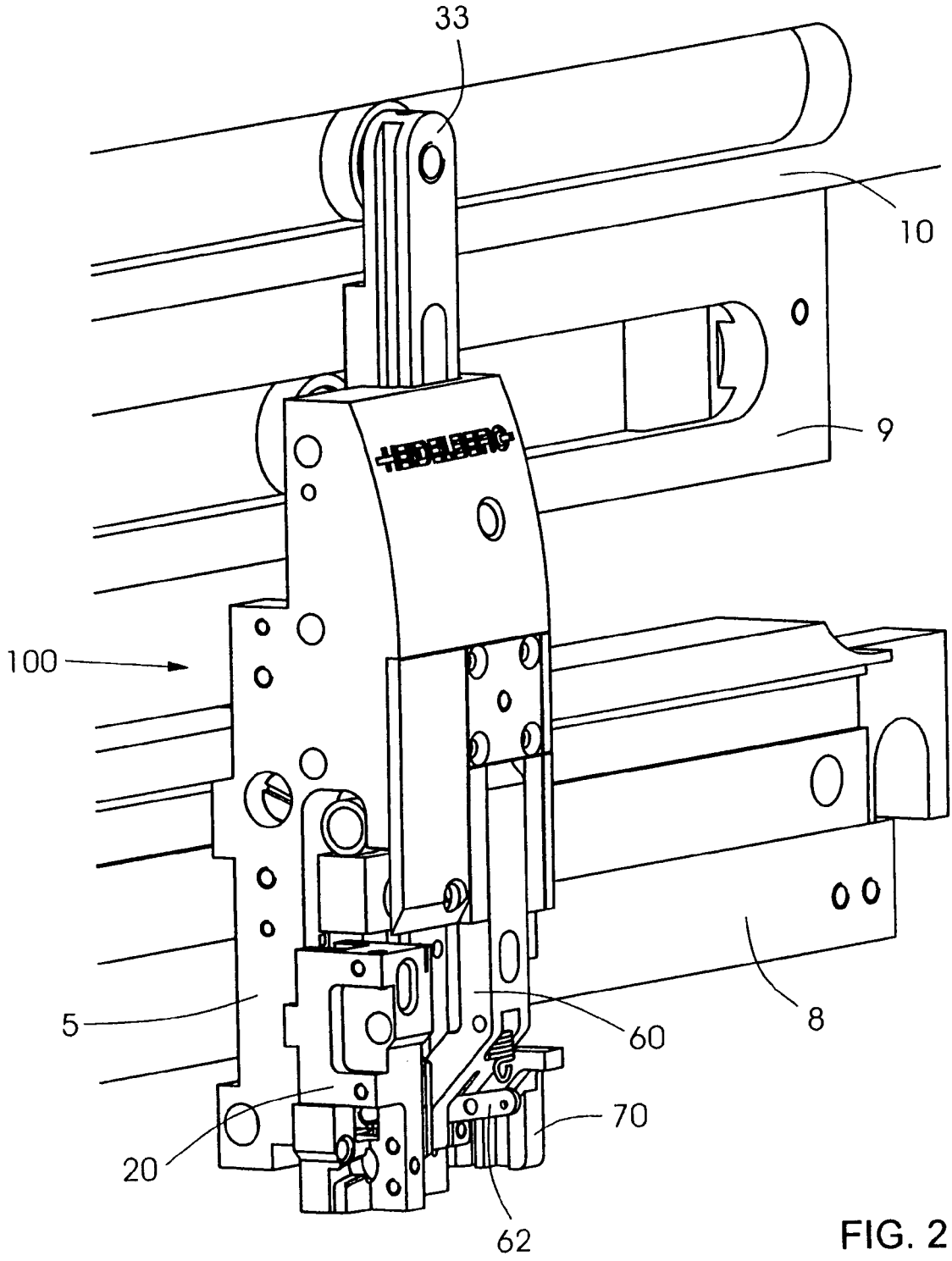
FIG. 2 is a fragmentary, perspective, overall view of one embodiment of the stitching apparatus according to the invention.
Figure 3:
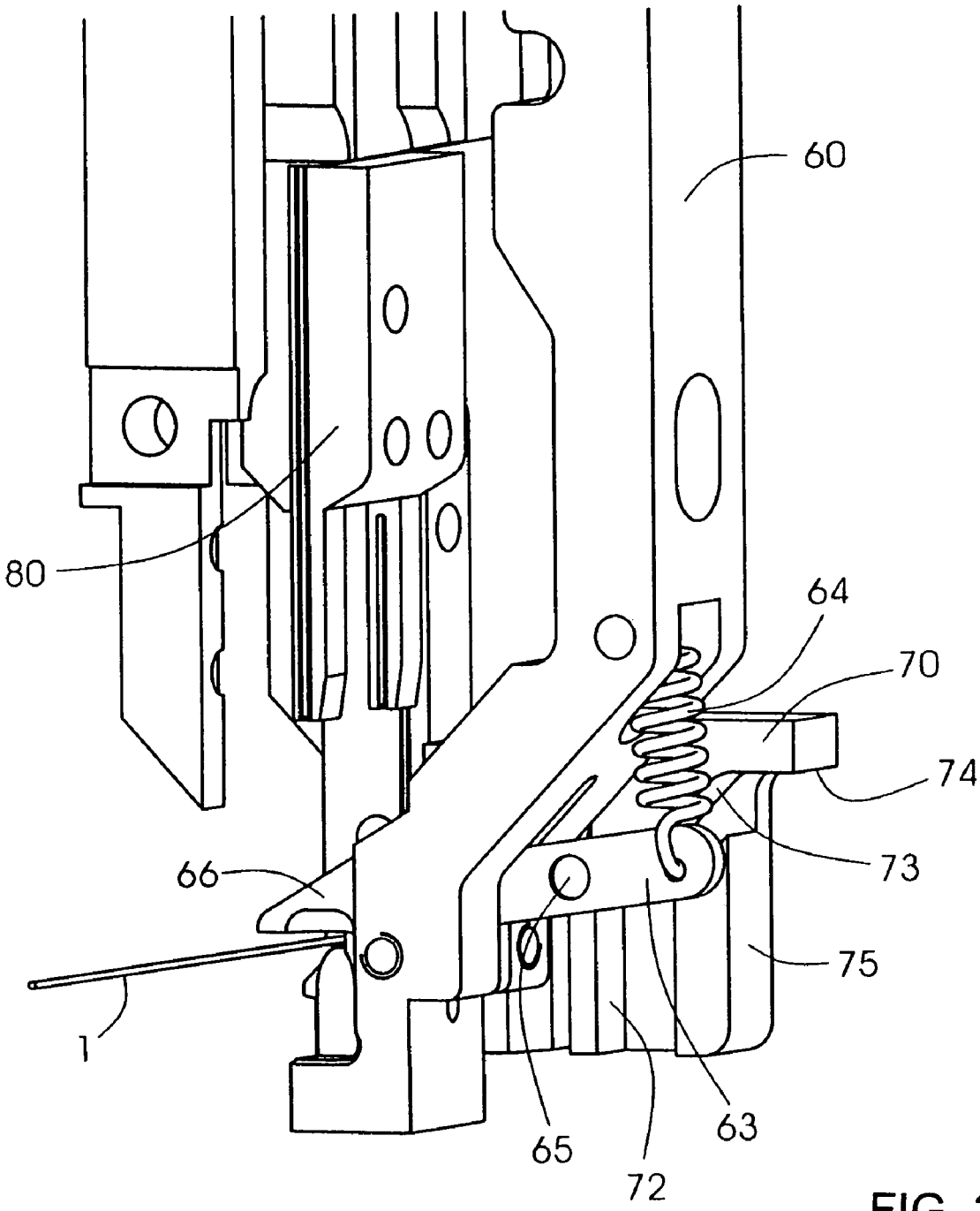
FIG. 3 is a front-perspective view of a driver, a former and a control block, inter alia, of the stitching apparatus according to the invention.
Figure 4:
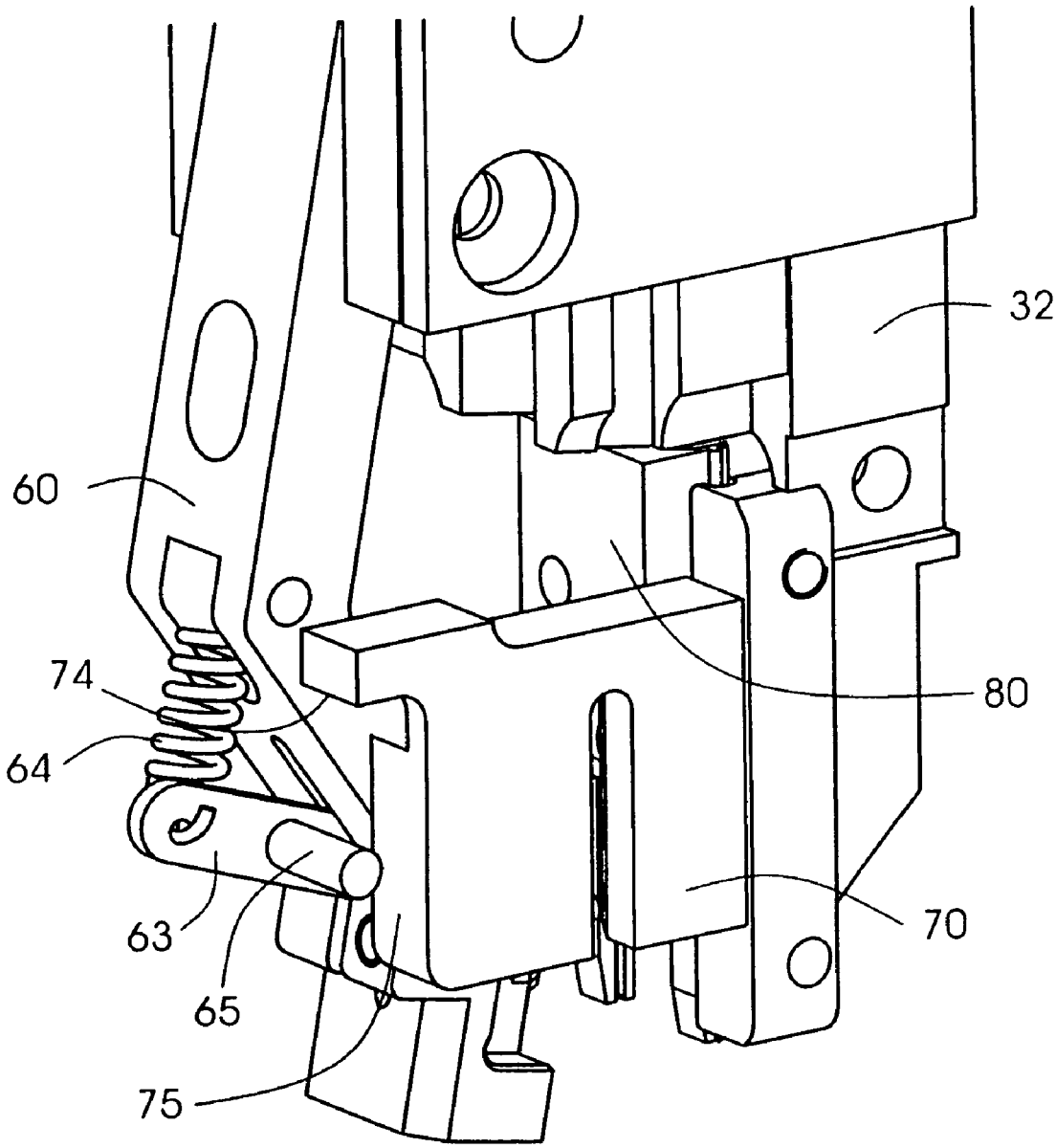
FIG. 4 is a rear-perspective view of the driver, the former and the control block, inter alia, of the stitching apparatus according to the invention.

Referring now in detail to FIGS. 2-4 of the drawings as a whole, there is seen an embodiment of a stitching apparatus 100 according to the invention which is restricted to an illustration and a description of details that are important to the invention. Further elements that are required for the operation of the stitching apparatus 100, such as guide devices, controllers, drives, fastening devices etc. which, in particular, also do not differ from the prior art or are borrowed from the latter, are not described in further detail and/or are omitted for clarity.

FIG. 2 shows a preferred embodiment of the stitching apparatus 100 according to the invention. A stitching head basic body 5 is fixedly connected to a holding rail 8. In addition to lateral displacement of the holding rail 8, control rails 9, 10 are moved vertically. As a result of superimposition of these movements, remaining movements of the stitching apparatus are derived by a closer slide 32 and a driver slide 33. A cutting box 20 is disposed on the stitching head basic body 5. The stitching wire 1 is introduced into the cutting box 20 from the left in FIG. 2 and is cut in accordance with a required wire length. In this case, the required wire length depends, for example, on the thickness of the stack which is to be stitched, and on the type of wire stitching, that is to say for instance annular eyelet stitching or normal stapling. However, a stitching apparatuses 100 of the generic type can typically carry out only one type of stitching in each case.

In order to ensure that the cut stitching wire 1 does not fall down, the stitching wire is clamped fixedly on the former 60 by a clamping jaw 66 (see FIG. 3) which is actuated by a wire clamping lever 63. The former 60 is controlled by a cam in such a way that it preshapes a piece of the cut stitching wire 1 into a desired staple shape having open staple limbs, that is to say for instance into an annular eyelet or a normal staple. This preshaped staple is then driven into the stack through the use of the driver 80. A non-illustrated closer which is known to the person skilled in the art is disposed on the rear side of the stack. The closer closes the staple, but the closer is not part of the apparatus 100 according to the invention.

The former 60 transfers the preshaped staple to the driver 80. To this end, firstly the staple has to then be released for the downward movement of the driver 80, and secondly the former 60 has to be pivoted out of the path of the driver 80. This is then achieved in an inventive manner solely through the use of a control bolt 65 which is disposed on the wire clamping lever 63 and interacts with a control cam 72 of a control block 70, as FIGS. 3 and 4 show. The control block 70 is disposed on the closer slide 32 and is moved up and down in the vertical direction with the closer slide 32. The former 60 is connected pivotably to the stitching head basic body 5 in such a way as to be fixed on the unit.

During the downward movement of the driver 80, the control bolt 65 is situated in a left-hand groove of the control cam 72 in the control block 70, as is seen in FIG. 3. The wire clamping lever 63 clamps the cut and shaped stitching wire 1. If the driver 80 is moved further downward, the control bolt 65 comes into contact with a diagonal control cam 73. Due to the spring force of a spring 64, the clamping jaw 66 remains closed, but the entire former 60 is pivoted outward, with the result that no collision occurs between the former 60 and the driver 80. Finally, the driver 80 and the control block 70 are lowered to such an extent that the control bolt 65 comes into contact with a horizontal control face 74 which then opens the clamping jaw 66. At this instant, the driver 80 has taken over the staple and drives it into the stack. During the following upward movement, the control bolt 65 slides on a right-hand vertical control face 75 of the control block 70 and therefore prevents the former 60 from being pivoted-in, before new stitching wire 1 is again advanced, in order to shape a new staple.

The stitching apparatus according to the invention can be used in all stitching apparatuses, not only in gathering and stitching machines but also in copiers or digital printers or other apparatuses for further print processing, as well as for the manufacture of staples in wood or metal processing or in furniture manufacture, for instance during the manufacture of picture frames or the like.

We claim:

1. A stitching apparatus for manufacturing stitching wire staples for stitching stacked sheet materials, the apparatus comprising:

a stitching head basic body having a driver for driving the stitching wire staples into the stacked sheet materials in a downward movement of said driver;

a former for shaping the stitching wire staples, said former being pivoted away during said downward movement of said driver; and a wire clamping lever being mounted pivotably in and relative to said former, said wire clamping lever having a control element running on a control cam to support said former in an upward movement of said driver, for pivoting-in said former in said upward movement to a different point than a pivoting-out of said former in said downward movement.

2. The stitching apparatus according to claim 1, wherein the staples are annular eyelet staples.

3. The stitching apparatus according to claim 1, wherein said control element is a bolt.

4. The stitching apparatus according to claim 1, which further comprises a control block disposed on a slide, said control cam being formed on said control block.

* * * * *